US011155911B2

(12) United States Patent
Renshaw et al.

(10) Patent No.: US 11,155,911 B2
(45) **Date of Patent: *Oct. 26, 2021**

(54) METAL-COATED STEEL STRIP

(71) Applicants: Bluescope Steel Limited, Melbourne (AU); Nippon Steel & Sumitomo Metal Corporation, Tokyo (JP); Nippon Steel Coated Sheet Corporation, Tokyo (JP)

(72) Inventors: Wayne Andrew Renshaw, Unanderra (AU); Cat Tu, Balgownie (AU); Joe Williams, Tarrawanna (AU); Jason Hodges, East Corrimal (AU); Shiro Fujii, Tokyo (JP); Nobuyuki Shimoda, Tokyo (JP); Shuichi Kondo, Tokyo (JP); Takashi Hirasawa, Tokyo (JP)

(73) Assignees: Bluescope Steel Limited, Melbourne (AU); Nippon Steel Corporation, Tokyo (JP); Nippon Steel Coated Sheet Corporation, Tokyo (JP)

( * ) Notice: Subject to any disclaimer, the term of this patent is extended or adjusted under 35 U.S.C. 154(b) by 116 days.

This patent is subject to a terminal disclaimer.

(21) Appl. No.: 14/777,588

(22) PCT Filed: Mar. 6, 2014

(86) PCT No.: PCT/AU2014/000213
§ 371 (c)(1),
(2) Date: Sep. 16, 2015

(87) PCT Pub. No.: WO2014/134675
PCT Pub. Date: Sep. 12, 2014

(65) Prior Publication Data

US 2016/0273086 A1 Sep. 22, 2016

(30) Foreign Application Priority Data

Mar. 6, 2013 (AU) ..... 2013900763

(51) Int. Cl.
*C23C 2/40* (2006.01)
*C23C 2/06* (2006.01)
(Continued)

(52) U.S. Cl.
CPC ..... *C23C 2/40* (2013.01); *C22C 18/04* (2013.01); *C22C 21/10* (2013.01); *C23C 2/02* (2013.01);
(Continued)

(58) Field of Classification Search
CPC .... C23C 2/40; C23C 2/06; C23C 2/12; C23C 2/26; C23C 2/02; C22C 18/04; C22C 21/10
See application file for complete search history.

(56) References Cited

FOREIGN PATENT DOCUMENTS

| | | |
|---|---|---|
| EP | 1225246 | 7/2002 |
| NZ | 575787 A | 3/2012 |

(Continued)

OTHER PUBLICATIONS

European Search Report for Application No. 14760015.9 dated Mar. 11, 2016 (6 pages).

(Continued)

*Primary Examiner* — John E Uselding
(74) *Attorney, Agent, or Firm* — Michael Best & Friedrich LLP

(57) ABSTRACT

A method of forming an Al—Zn—Si—Mg alloy coating on a steel strip includes dipping steel strip into a bath of molten Al—Zn—Si—Mg alloy and forming a coating of the alloy on exposed surfaces of the steel strip. The method also includes controlling conditions in the molten coating bath and downstream of the coating bath so that there is a uniform Al/Zn ratio across the surface of the coating formed on the steel strip. An Al—Zn—Mg—Si coated steel strip includes
(Continued)

a uniform Al/Zn ratio on the surface or the outermost 1-2 μm of the Al—Zn—Si—Mg alloy coating.

12 Claims, 2 Drawing Sheets

(51) Int. Cl.

| | |
|---|---|
| ***C23C 2/12*** | (2006.01) |
| ***C23C 2/26*** | (2006.01) |
| ***C23C 2/02*** | (2006.01) |
| ***C22C 18/04*** | (2006.01) |
| ***C22C 21/10*** | (2006.01) |

(52) U.S. Cl.
CPC ..... *C23C 2/06* (2013.01); *C23C 2/12* (2013.01); *C23C 2/26* (2013.01)

(56) References Cited

FOREIGN PATENT DOCUMENTS

| | | |
|---|---|---|
| WO | 2008025066 | 3/2008 |
| WO | 2009/111842 A1 | 9/2009 |

OTHER PUBLICATIONS

International Search Report for Application No. PCT/AU2013/000213 dated Jun. 13, 2014 (3 pages).
International Preliminary Report on Patentability for Application No. PCT/AU2013/000213 dated Jul. 6, 2015 (5 pages).

METAL-COATED STEEL STRIP

FIELD OF THE INVENTION

The present invention relates to the production of metal strip, typically steel strip, which has a corrosion-resistant metal alloy coating that contains aluminium, zinc, silicon, and magnesium as the main elements in the alloy, and is hereinafter referred to as an "Al—Zn—Si—Mg alloy" on this basis.

In particular, the present invention relates to a hot-dip metal coating method of forming an Al—Zn—Si—Mg alloy coating on a strip that includes dipping uncoated strip into a bath of molten Al—Zn—Si—Mg alloy and forming a coating of the alloy on the strip.

Typically, the Al—Zn—Si—Mg alloy of the present invention comprises the following ranges in % by weight of the elements Al, Zn, Si, and Mg:

Zn: 30 to 60%

Si: 0.3 to 3%

Mg: 0.3 to 10%

Balance: Al and unavoidable impurities.

More typically, the Al—Zn—Si—Mg alloy of the present invention comprises the following ranges in % by weight of the elements Al, Zn, Si, and Mg:

Zn: 35 to 50%

Si: 1.2 to 2.5%

Mg: 1.0 to 3.0%

Balance: Al and unavoidable impurities.

The Al—Zn—Si—Mg alloy coating may contain other elements that are present as deliberate alloying additions or as unavoidable impurities. Hence, the phrase "Al—Zn—Si—Mg alloy" is understood herein to cover alloys that contain such other elements as deliberate alloying additions or as unavoidable impurities. The other elements may include by way of example any one or more of Ca, Ti, Fe, Sr, Cr, and V.

Depending on the end-use application, the metal-coated strip may be painted, for example with a polymeric paint, on one or both surfaces of the strip. In this regard, the metal-coated strip may be sold as an end so product itself or may have a paint coating applied to one or both surfaces and be sold as a painted end product.

The present invention relates particularly but not exclusively to steel strip that is coated with the above-described Al—Zn—Si—Mg alloy and is optionally coated with a paint and thereafter is cold formed (e.g. by roll forming) into an end-use product, such as building products (e.g. profiled wall and roofing sheets).

BACKGROUND TO THE INVENTION

One corrosion resistant metal coating composition that is used widely in Australia and elsewhere for building products, particularly profiled wall and roofing sheets, is a 55% by weight Al—Zn coating composition that also comprises Si. It is noted that, unless otherwise stated, all references to percentages are references to percentages by weight.

The profiled sheets are usually manufactured by cold forming painted, metal alloy coated strip.

Typically, the profiled sheets are manufactured by roll-forming the painted strip.

The microstructure of coatings of the coating composition on profiled sheets typically comprises Al-rich dendrites and Zn-rich interdendritic channels.

The addition of Mg to this known composition of 55% Al—Zn—Si coating composition has been proposed in the patent literature for a number of years, see for example U.S. Pat. No. 6,635,359 in the name of Nippon Steel Corporation, but Al—Zn—Si—Mg coatings on steel strip are not commercially available in Australia.

It has been established that when Mg is included in a 55% Al—Zn—Si coating composition, Mg brings about certain beneficial effects on product performance, such as improved cut-edge protection.

The applicant has carried out extensive research and development work in relation to Al—Zn—Si—Mg alloy coatings on strip such as steel strip which has included plant trials. The present invention is the result of part of this research and development work.

During the course of plant trials, the applicant noticed a defect on the surface of Al—Zn—Si—Mg alloy coated steel strip. The plant trials were carried out with an Al—Zn—Si—Mg alloy having the following composition, in wt. %: 53Al-43Zn-2Mg-1.5Si—0.45Fe and incidental impurities. The applicant was surprised that the defect occurred. The applicant had not observed the defect in extensive laboratory work on Al—Zn—Si—Mg alloy coatings. Moreover, since noticing the defect in plant trials, the applicant has not been able to reproduce the defect in the laboratory. The applicant has not observed the defect on standard 55% Al—Zn alloy coated steel strip that has been available commercially in Australia and elsewhere for many years.

The applicant has found that the defect has a number of different forms, including streaks, patches, and a wood grain pattern. The defect is described internally by the applicant as an "ash" mark.

A severe example of the defect is shown in FIG. 1, which is a photograph of a part of the surface of an Al—Zn—Si—Mg alloy coated steel strip from the plant trials captured under outdoor viewing conditions—low angle in direct sunlight. In FIG. 1 the defect manifests itself as darker areas taking a number of shapes. In this example the ash mark defect appears as (a) a patch (a well-defined area that is uniformly darker than the surrounding area), (b) a streak (a narrow area extending along the length of the strip which is darker than the surrounding area) and (c) a wood grain pattern (an area extending along the length of the strip, with clear darker lines and lighter lines between the darker lines. i.e. similar to a wood grain), on the coated steel strip surface when viewed at low viewing angles under "optimum" lighting. The applicant has found that as the viewing angle increases towards the perpendicular, the visual distinction of the defect rapidly decreases until it can no longer be seen, with no obvious coating artefacts present at the surface, e.g. metal spots, dross or spangle variation.

The applicant has found that the defect is not confined to the morphologies shown in FIG. 1 and can be other configurations of darker areas.

The defect is a concern to the applicant from the viewpoint of the aesthetic appearance of coated strip. This is a very important issue commercially.

The above discussion is not to be taken as an admission of the common general knowledge in Australia and elsewhere.

SUMMARY OF THE INVENTION

The applicant has found that the above-described ash mark defect is due to variations in the Al/Zn ratio on the surface of Al—Zn—Si—Mg alloy coatings, specifically, a decrease in the surface Al/Zn ratio within the defect area, owing to an increased average width of Zn-rich interdendritic channels on the surface of the coatings.

The applicant has observed that the variations in Al/Zn ratio that are relevant to the defect are in, but not necessarily limited to the outermost 1-2 μm of the coating cross section.

The applicant has also found that the defect is most easily detected by elemental mapping of the defect boundary with an electron probe microanalyser According to the present invention there is provided a method of forming a coating of an Al—Zn—Si—Mg-based alloy on a substrate, such as although not limited to a steel strip, that is characterised by controlling conditions in (a) a bath containing the Al—Zn—Si—Mg-based alloy for coating the substrate and (b) downstream of the molten coating bath so that there is a uniform Al/Zn ratio across the surface of the coating formed on the substrate.

The term "uniform" in the context of the Al/Zn ratio is understood herein to mean a variation of less than 0.1 in the Al/Zn ratio between any two or more independent 1 mm×1 mm areas as measured by Energy Dispersive X-Ray Spectroscopy (EDS).

Notwithstanding the aforementioned Al/Zn ratio variation limit, the suitability of the coating for commercial use and hence the meaning of the word "uniform" is defined by the visual surface appearance under optimum lighting conditions.

According to the present invention there is provided a method of forming an Al—Zn—Si—Mg alloy coating on a steel strip to form the above-described Al—Zn—Mg—Si coated steel strip, the method including dipping steel strip into a bath of molten Al—Zn—Si—Mg alloy and forming a coating of the alloy on exposed surfaces of the steel strip, and the method including controlling conditions in the molten coating bath and downstream of the coating bath so that there is a uniform Al/Zn ratio across the surface of the coating formed on the steel strip.

Whilst not wishing to be bound to the following comment, the applicant believes that the defect may be due to a non-uniform surface/sub-surface distribution of $Mg_2Si$ in the microstructure of the coatings. The applicant has observed an increased nucleation rate of $Mg_2Si$ in the lower half of the coating cross section within the defect region.

The method may include controlling any suitable conditions in the molten coating bath and downstream of the coating bath.

By way of example, the method may include controlling any one or more of the composition of the molten coating bath, and the rate of cooling the coated steel strip after the coated steel strip leaves the molten coating bath.

Typically, the method includes controlling the Ca concentration of the molten coating bath.

Typically, the Ca concentration of the molten coating bath is determined by a generally standard practice in the industry of taking coating bath samples and analysing the samples by any one of a number of known analysis options such as XRF and ICP, with measurement tolerances typically of plus/minus 10 ppm.

The method may include controlling the Ca concentration to be at least 100 ppm.

The method may include controlling the Ca concentration to be at least 120 ppm.

The method may include controlling the Ca concentration to be less than 200 ppm.

The method may include controlling the Ca concentration to be less than 180 ppm.

The Ca concentration may be any other suitable concentration range.

Typically, the method includes controlling the Mg concentration of the molten coating bath.

Typically, the Mg concentration of the molten coating bath is determined by a generally standard practice in the industry of taking coating bath samples and analysing the samples by any one of a number of known analysis options such as XRF and ICP, with measurement tolerances typically of plus/minus 10 ppm.

The method may include controlling the Mg concentration to be at least 0.3%.

The method may include controlling the Mg concentration to be at least 1.8%.

The method may include controlling the Mg concentration to be at least 1.9%.

The method may include controlling the Mg concentration to be at least 2%.

The method may include controlling the Mg concentration to be at least 2.1%.

The Mg concentration may be any other suitable concentration range.

The method may include controlling the post-coating bath cooling rate to be less than 40° C./s while the coated strip temperature is in the temperature range 400° C. to 510° C.

The applicant has found that, for the coating alloy compositions tested, the coating temperature range of 400° C. to 510° C. is significant and that cooling quickly in this range is undesirable due to accentuating variations in the Al/Zn ratio to the extent that the differences become visually apparent as the ash mark defect. The selection of the cooling rate to be less than 40° C./s within this temperature range is based on minimising accentuating variations in the Al/Zn ratio.

The applicant has also found that coating temperatures below 400° C. have no significant impact on the Al/Zn ratio at the surface of a coating.

The applicant has also found that temperatures above 510° C. have no significant impact on the uniformity of Al/Zn ratio.

It is emphasised that, in any given situation, the limits of the significant temperature range will be dependent on the coating alloy composition and the invention is not necessarily confined to the coating temperature range of 400° C. to 510° C.

The method may include controlling the post-coating bath cooling rate to be less than 35° C./s while the coated strip temperature is in the temperature range 400° C. to 510° C.

The method may include controlling the post-coating bath cooling rate to be greater than 10° C./s in the temperature range 400° C. to 510° C.

The method may include controlling the post-coating bath cooling rate to be greater than 15° C./s in the temperature range 400° C. to 510° C.

Typically, the cooling rate of coated strip is controlled via a computerised model.

The applicant believes that the selection of any one or more than one of Ca concentration, Mg concentration and post-coating bath cooling rate is independent of coating mass.

In general terms, the invention appears to be independent of coating mass.

Typically, the coating mass is 50-200 $g/m^2$.

The Al—Zn—Si—Mg alloy may comprise more than 1.8% by weight Mg.

The Al—Zn—Si—Mg alloy may comprise more than 1.9% Mg.

The Al—Zn—Si—Mg alloy may comprise more than 2% Mg.

The Al—Zn—Si—Mg alloy may comprise more than 2.1% Mg.

The Al—Zn—Si—Mg alloy may include less than 3% Mg.

The Al—Zn—Si—Mg alloy may include less than 2.5% Mg.

The Al—Zn—Si—Mg alloy may include more than 1.2% Si.

The Al—Zn—Si—Mg alloy may include less than 2.5% Si.

The Al—Zn—Si—Mg alloy may include the following ranges in % by weight of the elements Al, Zn, Si, and Mg:

Zn: 30 to 60%

Si: 0.3 to 3%

Mg: 0.3 to 10%

Balance: Al and unavoidable impurities.

In particular, the Al—Zn—Si—Mg alloy may include the following ranges in % by weight of the elements Al, Zn, Si, and Mg:

Zn: 35 to 50%

Si: 1.2 to 2.5%

Mg: 1.0 to 3.0%

Balance: Al and unavoidable impurities.

The steel may be a low carbon steel.

According to the present invention there is also provided an Al—Zn—Mg—Si coated steel strip produced by the above-described method.

According to the present invention there is also provided an Al—Zn—Mg—Si coated steel strip that includes a uniform Al/Zn ratio on the surface of the Al—Zn—Si—Mg alloy coating.

According to the present invention there is also provided an Al—Zn—Mg—Si coated steel strip that includes a uniform Al/Zn ratio on the surface or the outermost 1-2 μm of the Al—Zn—Si—Mg alloy coating.

According to the present invention there is also provided a profiled wall and roofing sheet that has been roll formed or press formed or otherwise formed from the above-described Al—Zn—Mg—Si coated steel strip.

DESCRIPTION OF DRAWINGS

The present invention is described further by way of example with reference to the accompanying drawings of which.

DESCRIPTION OF EMBODIMENT OF THE INVENTION

Figure 2:
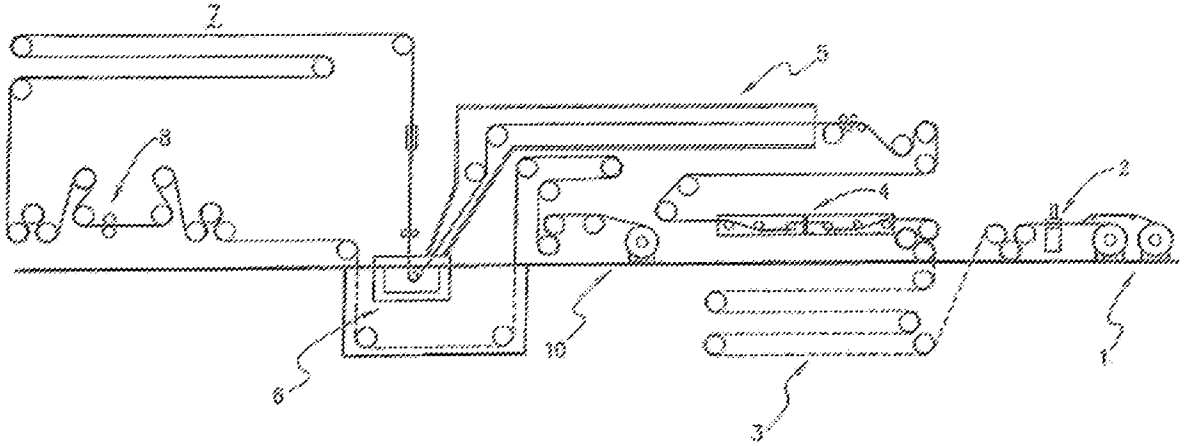
FIG. 2 is a schematic drawing of one embodiment of a continuous production line for producing steel strip coated with an Al—Zn—Si—Mg alloy in accordance with the method of the present invention.

With reference to FIG. 2, in use, coils of cold-rolled low carbon steel strip are uncoiled at an uncoiling station 1 and successive uncoiled lengths of strip are welded end to end by a welder 2 and form a continuous length of strip.

The strip is then passed successively through an accumulator 3, a strip cleaning section 4 and a furnace assembly 5. The furnace assembly 5 includes a preheater, a pre-heat reducing furnace, and a reducing furnace.

The strip is heat treated in the furnace assembly by careful control of process variables including: (i) to the temperature profile in the furnaces, (ii) the reducing gas concentration in the furnaces, (iii) the gas flow rate through the furnaces, and (iv) strip residence time in the furnaces (i.e. line speed).

The process variables in the furnace assembly 5 are controlled so that there is removal of iron oxide residues from the surface of the strip and removal of residual oils and iron fines from the surface of the strip.

The heat treated strip is then passed via an outlet snout downwardly into and through a molten bath containing an Al—Zn—Si—Mg alloy having a Ca concentration in a range of 100-200 ppm in a coating pot 6 and is coated with Al—Zn—Si—Mg alloy. The Al—Zn—Si—Mg alloy is maintained molten in the coating pot at a selected temperature in a range of 595-610° C. by use of heating inductors (not shown). Within the bath the strip passes around a sink roll and is taken upwardly out of the bath. The line speed is selected to provide a selected immersion time of strip in the coating bath to produce a coating having a coating mass of 50-200 g/m$^2$ on both surfaces of the strip.

After leaving the coating bath 6 the strip passes vertically through a gas wiping station (not shown) at which its coated surfaces are subjected to jets of wiping gas to control the thickness of the coating.

The coated strip is then passed through a cooling section 7 and subjected to forced cooling at a selected cooling rate greater than 10° C./s but less than 40° C./s while the coated strip temperature is between 400° C. and 510° C. The cooling rate may be any suitable cooling rate at coated strip temperatures less than 400° C. or greater than 510° C.

The cooled, coated strip is then passed through a rolling section 8 that conditions the surface of the coated strip.

The coated strip is thereafter coiled at a coiling station 10.

Figure 1:
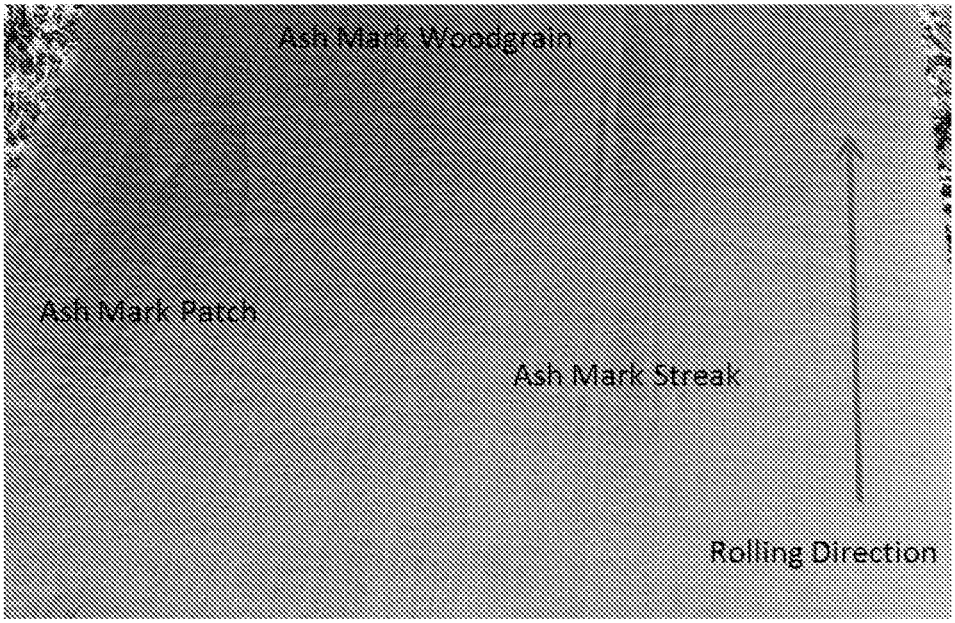
FIG. 1 is the above-described photograph of part of the surface of the Al—Zn—Si—Mg alloy coated steel strip from the plant trials captured under ideal viewing conditions.

As discussed above, the applicant has conducted extensive research and development work in relation to Al—Zn—Si—Mg alloy coatings on steel strip which includes plant trials and the applicant noticed a defect on the surface of Al—Zn—Si—Mg alloy coated steel strip during plant trials. The plant trials were carried out with an Al—Zn—Si—Mg alloy having the following composition, in wt. %: 53Al-43Zn-2Mg-1.5Si—0.45Fe and incidental impurities. The applicant was surprised that the defect occurred. The applicant had not observed the defect in extensive laboratory work on Al—Zn—Si—Mg alloy coatings. Moreover, since noticing the defect in plant trials, the applicant has not been able to reproduce the defect in the laboratory. The applicant has not observed the defect on standard 55% Al—Zn alloy coated steel strip that has been available commercially in Australia and elsewhere for many years. Moreover, as discussed above, the applicant has found that the defect has a number of different forms, including streaks, patches, and a wood grain pattern, and severe examples of each of these forms of the defect are shown in FIG. 1.

As is discussed above, the applicant has found that the above-described defect is due to variations in the Al/Zn ratio on the surface of Al—Zn—Si—Mg alloy coatings and may be due to a non-uniform distribution of $Mg_2Si$ in the microstructure of the of coatings and the invention includes controlling conditions in the molten coating bath and downstream of the coating bath so that there is a uniform Al/Zn ratio across the surface of the coating formed on the steel strip.

The method of the invention includes controlling any suitable conditions in the molten coating bath and downstream of the coating bath so that there is a uniform Al/Zn ratio (in accordance with the definition on page 5) across the surface of the coating, i.e. on or within the outermost 1-2 μm of the coating cross section, formed on the steel strip.

By way of example, the embodiment of the method of the invention described in relation to FIG. 2 includes controlling (a) the Ca concentration in the molten coating bath, (b) the Mg concentration of the molten coating bath, and (c) the rate of cooling the coated steel strip after the coated steel strip leaves the molten coating bath, as described above in the description of FIG. 2.

It is noted that the invention is not confined to controlling this combination of conditions.

Many modifications may be made to the present invention described above without departing from the spirit and scope of the invention.

The invention claimed is:

1. A method of forming an Al—Zn—Si—Mg alloy coating on a steel strip having no visual apparent ash mark defect, the method including:

dipping the steel strip into a bath of molten Al—Zn—Si—Mg alloy containing, in % by weight, Zn: 30% to 60%

Si: 0.3% to 3%

Mg: more than 1.8% to and less than 3.0%

Balance: Al and unavoidable impurities;

forming a coating of the alloy on exposed surfaces of the steel strip;

controlling Ca composition of the molten Al—Zn—Si—Mg alloy in the bath to be at least 100 ppm and less than 200 ppm, and controlling the rate of cooling of a coated steel strip after the coated steel strip leaves the bath to be greater than 10° C./s and less than 40° C./s while the coated strip temperature is between 400° C. and 510° C., so that there is a uniform Al/Zn ratio across the surface of the coating formed on the steel strip such that a variation in an Al/Zn ratio between two or more independent areas on a surface of the coating formed on the steel strip is less than 0.1.

2. The method defined in claim 1 includes controlling the Ca concentration of the molten coating bath to be less than 180 ppm.

3. The method defined in claim 1 wherein the Al—Zn—Si—Mg alloy includes less than 2.5% by weight Mg.

4. The method defined in claim 1 wherein the Al—Zn—Si—Mg alloy includes more than 1.2% by weight Si.

5. The method defined in claim 1 wherein the Al—Zn—Si—Mg alloy includes less than 2.5% by weight Si.

6. The method defined in claim 1 wherein the Al—Zn—Si—Mg alloy includes:

Zn: 35% to 50%

Si: 1.2% to 2.5%

Mg: more than 1.8% to and less than 3.0%

Balance: Al and unavoidable impurities.

7. The method defined in claim 1 includes controlling the Ca concentration of the molten coating bath to be at least 120 ppm.

8. The method defined in claim 1 including taking a sample from the molten coating bath and measuring the Ca concentration and the Mg concentration in the molten coating bath.

9. The method defined in claim 1 wherein the coating has uniform surface/sub-surface distribution of $Mg_2Si$ in the microstructure of the coating.

10. The method defined in claim 1 including controlling the cooling rate of the coated strip to be less than 35° C./s while the coated strip temperature is between 400° C. and 510° C.

11. The method defined in claim 1 wherein the coated strip has a coating mass of 50-200 $g/m^2$.

12. The method defined in claim 1 wherein the Al—Zn—Si—Mg alloy is maintained molten in the coating bath at a temperature in a range of 595-610° C.

* * * * *